US011050149B2

(12) United States Patent
Liao et al.

(10) Patent No.: US 11,050,149 B2
(45) Date of Patent: Jun. 29, 2021

(54) DUAL-BAND ANTENNA

(71) Applicants: Wen-Jiao Liao, Taipei (TW); Jhin-Ciang Chen, Taipei (TW); Shih-Chia Liu, Taipei (TW); Liang-Che Chou, Taipei (TW); Yen-Hao Yu, Taipei (TW); Li-Chun Lee, Taipei (TW)

(72) Inventors: Wen-Jiao Liao, Taipei (TW); Jhin-Ciang Chen, Taipei (TW); Shih-Chia Liu, Taipei (TW); Liang-Che Chou, Taipei (TW); Yen-Hao Yu, Taipei (TW); Li-Chun Lee, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 49 days.

(21) Appl. No.: 16/683,172

(22) Filed: Nov. 13, 2019

(65) Prior Publication Data

US 2020/0161764 A1 May 21, 2020

Related U.S. Application Data

(60) Provisional application No. 62/767,518, filed on Nov. 15, 2018.

(51) Int. Cl.
*H01Q 9/00* (2006.01)
*H01Q 5/328* (2015.01)
(Continued)

(52) U.S. Cl.
CPC ..... *H01Q 5/328* (2015.01); *H01Q 1/241* (2013.01); *H01Q 5/45* (2015.01); *H01Q 5/50* (2015.01);
(Continued)

(58) Field of Classification Search
CPC ..... H01Q 9/16; H01Q 5/328; H01Q 5/45; H01Q 21/24; H01Q 1/242; H01Q 1/241; H01Q 5/50
(Continued)

(56) References Cited

U.S. PATENT DOCUMENTS

2013/0106670 A1* 5/2013 Pan ..... H01Q 1/38 343/843
2015/0084817 A1 3/2015 Yong

FOREIGN PATENT DOCUMENTS

TW 201108840 3/2011
TW 201212378 3/2012
TW 201804673 2/2018

OTHER PUBLICATIONS

"Office Action of Taiwan Counterpart Application", dated Aug. 11, 2020, p. 1-p. 5.

* cited by examiner

*Primary Examiner* — Joseph J Lauture
(74) *Attorney, Agent, or Firm* — JCIPRNET

(57) ABSTRACT

A dual-band antenna is provided. The dual-band antenna includes a first antenna, a second antenna, and a grounding component. The first antenna has a first feed point for transceiving a first signal. The second antenna has a second feed point. The grounding component is electrically coupled to the first feed point and the second feed point, wherein the grounding component forms a first path and a second path between the first feed point and the second feed point, wherein a first path length of the first path and a second path length of the second path are integer multiples of a first wavelength of the first signal.

10 Claims, 5 Drawing Sheets

(51) Int. Cl.

| | |
|---|---|
| ***H01Q 5/45*** | (2015.01) |
| ***H01Q 21/24*** | (2006.01) |
| ***H01Q 1/24*** | (2006.01) |
| ***H01Q 5/50*** | (2015.01) |
| *H01Q 9/16* | (2006.01) |

(52) U.S. Cl.
CPC ..... *H01Q 21/24* (2013.01); *H01Q 1/242* (2013.01); *H01Q 9/16* (2013.01)

(58) Field of Classification Search
USPC ..... 343/745, 843, 702, 767
See application file for complete search history.

DUAL-BAND ANTENNA

CROSS-REFERENCE TO RELATED APPLICATION

This application claims the priority benefit of U.S. provisional application Ser. No. 62/767,518, filed on Nov. 15, 2018. The entirety of the above-mentioned patent application is hereby incorporated by reference herein and made a part of this specification.

TECHNICAL FIELD

The invention relates to an antenna, and more particularly, to a dual band antenna.

BACKGROUND

In order to support multiple communication protocols, at present, mobile devices need to be disposed with multiple antennas or broadband antennas. In the case that multi-input multi-output (MIMO) technology has become the mainstream communication technology, mobile devices need to be disposed with at least two antennas of the same frequency band to implement MIMO technology. However, a mutual coupling between the antennas of the same frequency band has a negative impact to antenna performance, thereby reducing the transmission of MIMO. In order to reduce the mutual coupling between the antennas of the same frequency band, antenna engineers often reduce the influence of the mutual coupling by increasing a distance between the antennas of the same frequency band, but such approach will increase a size of the mobile device. Accordingly, how to reduce the coupling phenomenon for the antennas of the same frequency band without increasing the distance between the antennas of the same frequency band is one of the goals of those in the field.

SUMMARY

The invention provides a dual-band antenna capable of significantly reducing the mutual coupling between antennas of the same frequency band.

The dual-band antenna of the invention includes a first antenna, a second antenna, and a grounding component. The first antenna has a first feed point for transceiving a first signal. The second antenna has a second feed point. The grounding component is electrically coupled to the first feed point and the second feed point, wherein the grounding component forms a first path and a second path between the first feed point and the second feed point, wherein a first path length of the first path and a second path length of the second path are integer multiples of a first wavelength of the first signal.

In an embodiment of the invention, the second feed point is configured to transceive a second signal, and the first path length and the second path length are integer multiples of a second wavelength of the second signal.

In an embodiment of the invention, the grounding component is an annulus structure.

In an embodiment of the invention, the grounding component includes a meander structure, wherein the meander structure forms a part of the first path and a part of the second path.

In an embodiment of the invention, the grounding component includes an inductor, wherein the inductor forms a part of the first path and a part of the second path.

In an embodiment of the invention, the grounding component includes a hinge of a notebook computer.

In an embodiment of the invention, the first antenna is disposed in a second body of the notebook computer, and the second antenna is disposed in a first body of the notebook computer.

In an embodiment of the invention, the grounding component includes a first grounding part, a second grounding part and a third grounding part, wherein the second grounding part is a polyhedron and one of sections of the second grounding part is a C shape, wherein the second grounding part connects the first grounding part to the third grounding part.

In an embodiment of the invention, the first grounding part is a second polyhedron and one of sections of the first grounding part is an inverted-L shape, wherein the first feed point of the first antenna is disposed on a first side on the second polyhedron, wherein the first side is located at a lower edge of the inverted-L shape.

In an embodiment of the invention, the third grounding part is a cuboid, and the second feed point of the second antenna is disposed on a first side of the cuboid, wherein the first side is partially in contact with the second grounding part.

Based on the above, the dual-band antenna of the invention uses the grounding component to form the two paths between the two antennas, and the path length of each path is designed to be integer multiple of the wavelength of the input/output signal so as to reduce the mutual coupling between antennas.

DESCRIPTION OF THE EMBODIMENTS

Reference will now be made in detail to the exemplary embodiments of the invention, examples of which are illustrated in the accompanying drawings. In addition, whenever possible, identical or similar reference numbers stand for identical or similar elements in the figures and the embodiments. The language used to describe the directions such as "up", "down", "left", "right", "front", "back" or the like in the reference drawings is regarded in an illustrative rather than in a restrictive sense. Thus, the language used to describe the directions is not intended to limit the scope of the invention.

It should be understood that although the terms "first" and "second" or "a", "another" and "yet another" may be used herein to describe different elements, these elements should not be limited by these terms. These terms are only used to distinguish elements from one another. For example, a first element may be referred to as a second element, and, similarly, the second element may be referred to as the first element without departing from the scope of the inventive concept. As another example, an element may be referred to as another element, and, similarly, said another element may be referred to as yet another element without departing from the scope of the inventive concept.

Figure 1:
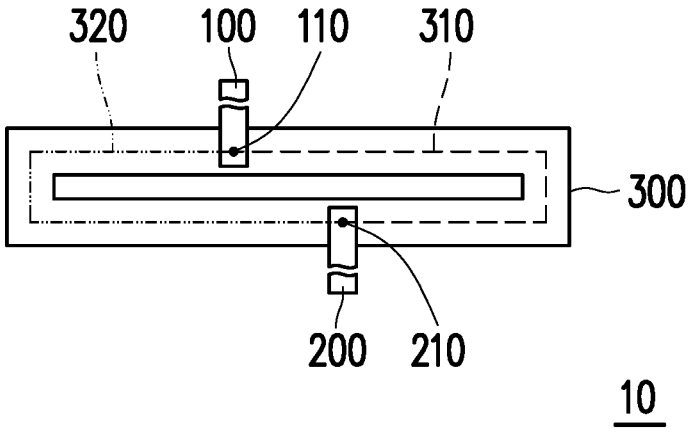
FIG. 1 is a schematic diagram illustrating a dual-band antenna according an embodiment of the invention.

FIG. 1 is a schematic diagram illustrating a dual-band antenna 10 according an embodiment of the invention. The dual-band antenna 10 includes a first antenna 100, a second antenna 200, and a grounding component 300. The dual-band antenna 10 can be mounted to an electronic device having a wireless communication function to enable the electronic device to transmit or receive wireless signals through the dual-band antenna 10 according to MIMO technology.

The first antenna 100 has a first feed point 110 for transmitting or receiving a first signal. Here, the first signal is, for example, a signal of 2.4 GHz or 2.45 GHz frequency band, but the invention is not limited thereto. The first antenna 100 is, for example, a monopole antenna, a dipole antenna, an inverted-L antenna, an inverted-F antenna (IFA), a planar IFA (PIFA), a loop antenna or a slot antenna, but the invention is not limited thereto. In an embodiment, the first antenna 100 is made of, for example, a flexible printed circuit (FPC) that can be bent according to the design requirements of antenna engineers.

The second antenna 200 has a second feed point 210 for transmitting or receiving a second signal. Here, the second signal is, for example, a signal of 2.4 GHz or 2.45 GHz frequency band, but the invention is not limited thereto. In a preferred embodiment of the invention, the first signal and the second signal are signals of the same frequency band. Nonetheless, the first signal and the second signal may also be signals of different frequency bands. The invention is not limited in this regard. The second antenna 200 is, for example, a monopole antenna, a dipole antenna, an inverted-L antenna, an inverted-F antenna (IFA), a planar IFA (PIFA), a loop antenna or a slot antenna, but the invention is not limited thereto. In an embodiment, the second antenna 200 is made of, for example, a flexible printed circuit that can be bent according to the design requirements of antenna engineers.

The grounding component 300 is electrically coupled to the first feed point 110 and the second feed point 210, and forms two paths between the first feed point 110 and the second feed point 210. Here, the two paths include a first path 310 and a second path 320. A path length of the first path 310 is, for example, integer multiple of a wavelength of the first signal (and the second signal), and a path length of the second path 320 is, for example, integer multiple of the wavelength of the first signal (and the second signal). When the path lengths of the first path 310 and the second path 320 are designed to be integer multiples of the wavelength of the first signal (and the second signal), a mutual coupling between the first antenna 100 and the second antenna 200 may be minimized.

In order to form the first path 310 and the second path 320 between the first antenna 100 and the second antenna 200, the grounding component 300 may be, for example, an annulus structure, as shown by FIG. 1.

Figure 2:
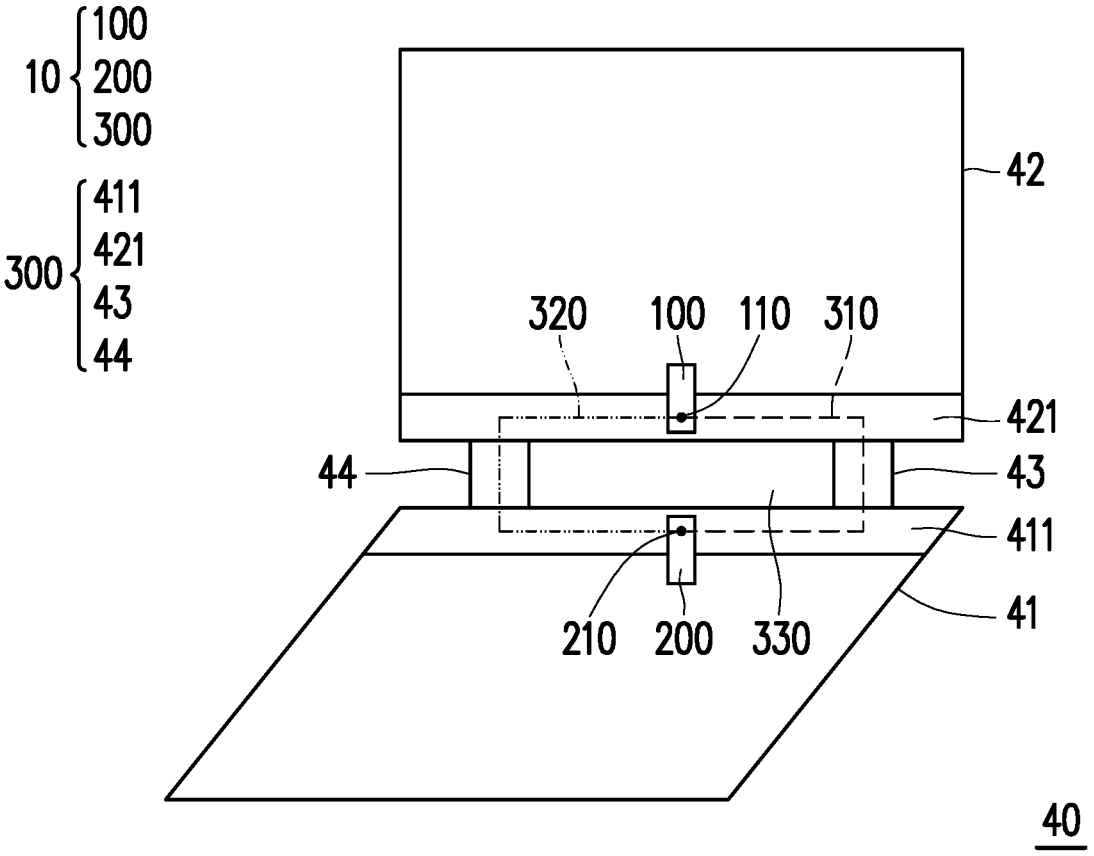
FIG. 2 is a schematic diagram illustrating the dual-band antenna disposed on a notebook computer according an embodiment of the invention.

FIG. 2 is a schematic diagram illustrating the dual-band antenna 10 disposed on a notebook computer 40 according an embodiment of the invention. In this embodiment, the grounding component 300 may be replaced by a part of the notebook computer 40.

The notebook computer 40 includes a first body 41, a second body 42, a hinge 43 and a hinge 44. The first body 41 includes a keyboard and the second body 42 includes a display, but not limited thereto. Two ends of the hinge 43 and two ends of the hinge 44 are connected to the first body 41 and the second body 42, respectively. The hinge 43 and the hinge 44 can allow the first body 41 and the second body 42 to rotate along a fixed axis of rotation relatively. The first body 41 may include an edge 411. Here, the edge 411 is an edge closest to the second body 42 among four edges of the first body 41. The second body 42 may include an edge 421. Here, the edge 421 is an edge closest to the first body 41 among four edges of the second body 42. In this embodiment, the first antenna 100 may be disposed in the second body 42 of the notebook computer 40, and the second antenna 200 may be disposed in the first body 41 of the notebook computer 40. A metallic material capable of grounding the first antenna 100 and the second antenna 200 is disposed inside (or on surfaces of) the edge 411, the edge 421, the hinge 43 and the hinge 44 of the notebook computer 40. Accordingly, the edge 411, the edge 421, the hinge 43 and the hinge 44 can constitute the grounding component 300.

The edge 411, the edge 421, the hinge 43 and the hinge 44 can form a slot 330, as shown by FIG. 2. Antenna engineers can simply adjust the path lengths of the first path 310 and the second path 320 by changing a size of the slot 330 so that the path lengths are integer multiples of the wavelength of the first signal (or the second signal). In other words, antenna engineers can adjust the path lengths of the first path 310 and the second path 320 by changing sizes of the edge 411, the edge 421, the hinge 43 or the hinge 44.

Figure 3:
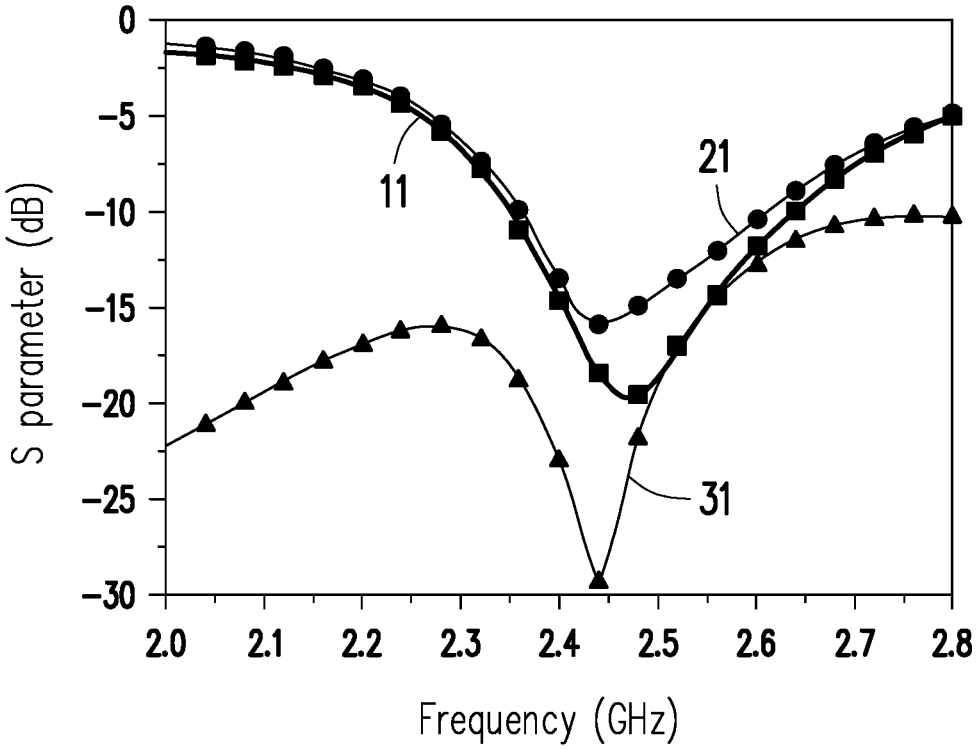
FIG. 3 is a schematic diagram illustrating S parameter of the dual-band antenna in FIG. 2 according an embodiment of the invention.

FIG. 3 is a schematic diagram illustrating S parameter of the dual-band antenna 10 in FIG. 2 according an embodiment of the invention. Here, a curve 11 represents S11 parameter of the first antenna 100, a curve 21 represents S11 parameter of the second antenna 200, and a curve 31 represents S21 parameter between the first antenna 100 and the second antenna 200. As shown by FIG. 3, when the path lengths of the first path 310 and the second path 320 are integer multiples of the wavelength of the first signal (or the second signal), the mutual coupling between the first antenna 100 and the second antenna 200 (i.e., S21 parameter) from 2.4 to 2.5 GHz may be less than −20 dB.

Figure 4A:
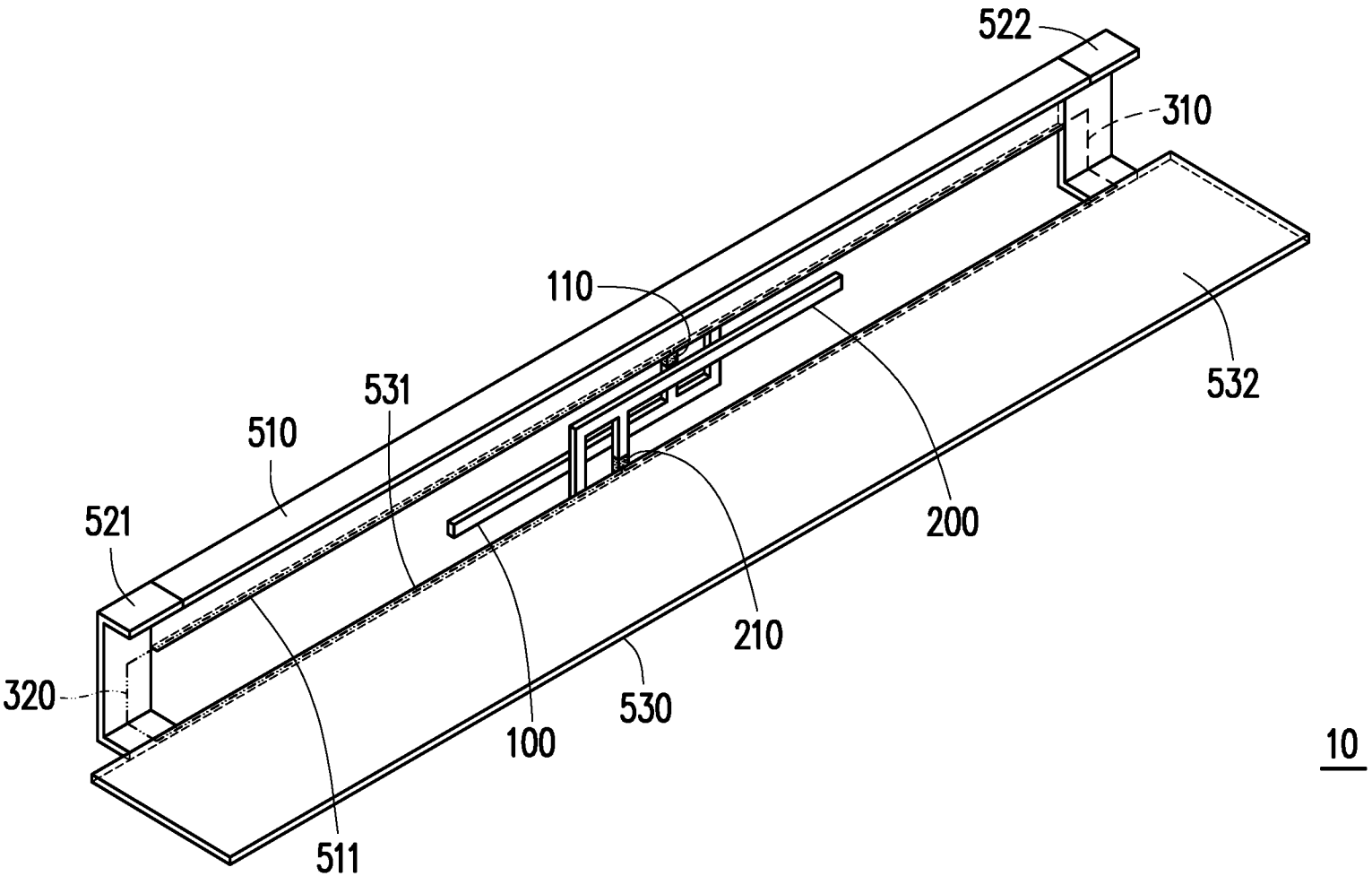
FIG. 4A is a schematic diagram illustrating the modularized dual-band antenna according an embodiment of the invention.
Figure 4B:
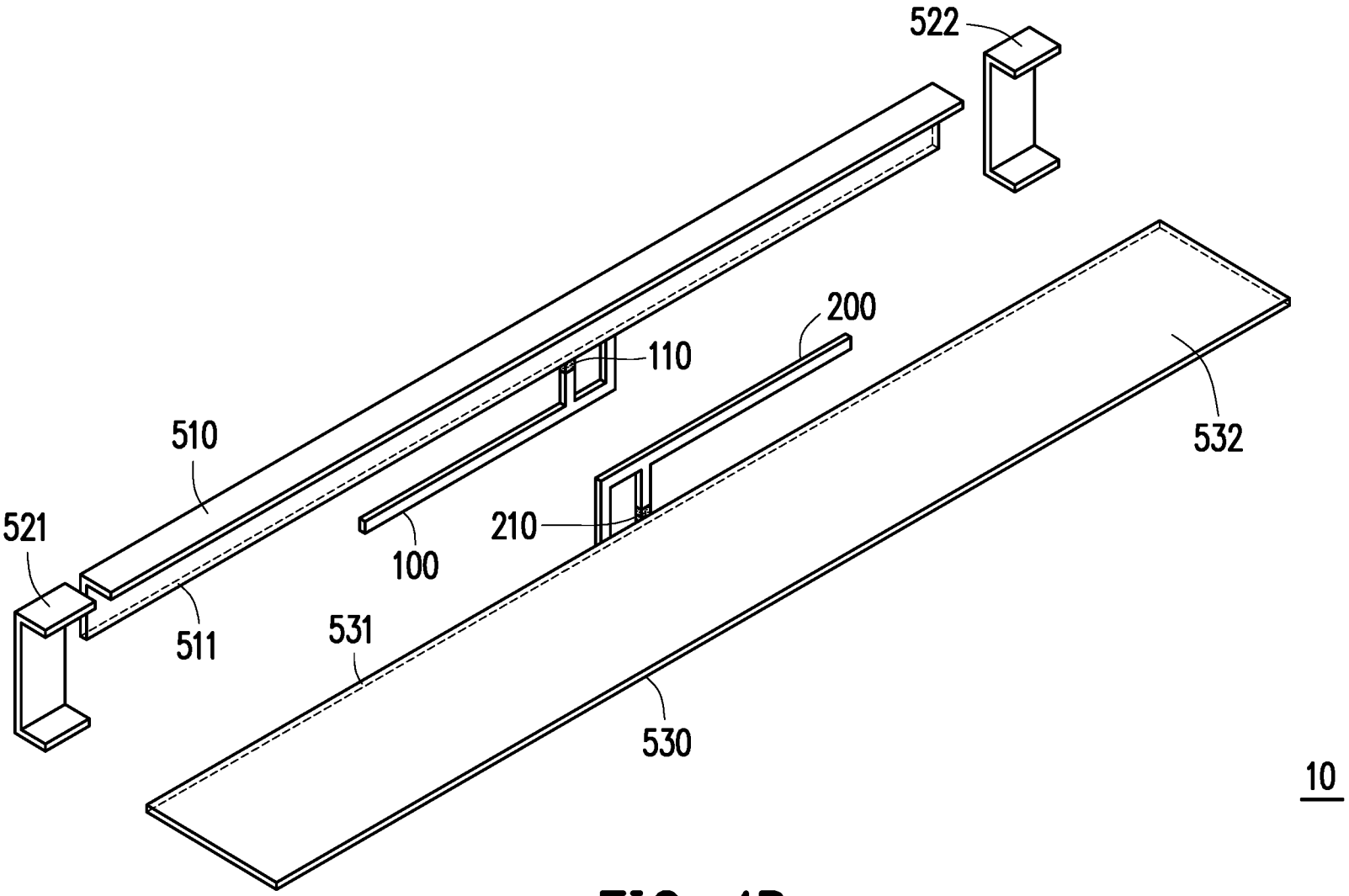
FIG. 4B is an exploded view illustrating the dual-band antenna in FIG. 4A according an embodiment of the invention.

FIG. 4A is a schematic diagram illustrating the modularized dual-band antenna 10 according an embodiment of the invention. FIG. 4B is an exploded view illustrating the dual-band antenna 10 in FIG. 4A according an embodiment of the invention. Referring to FIG. 4A and FIG. 4B together, in this embodiment, the grounding component 300 may include a first grounding part 510, a second grounding part 521, a third grounding part 530 and a fourth grounding part 522. Here, one end of the first grounding part 510 is connected to one end of the third grounding part 530 by the second grounding part 521, and another end of the first grounding part 510 is connected to another end of the third grounding part 530 by the fourth grounding part 522.

The first grounding part 510 is a polyhedron and one of sections of the first grounding part 510 may be an inverted-L shape, but not limited thereto. The first feed point 110 of the first antenna 100 may be disposed on one side of the first grounding part 510 (e.g., a side 511). The side 511 is located at a lower edge of the section of the inverted-L shape of the first grounding part 510 and the side 511 is not in contact with the second grounding part 521 and the fourth grounding part 522.

The third grounding part 530 is a cuboid. The second feed point 210 of the second antenna 200 may be disposed on one side of the third grounding part 530 (e.g., a side 531). The side 531 is in contact with the second grounding part 521 and the fourth grounding part 522, and the side 531 is the only side in contact with the second grounding part 521 and the fourth grounding part 522 among six sides of the third grounding part 530. In another embodiment, the second feed point 210 of the second antenna 200 may be disposed on another side of the third grounding part 530 (e.g., a side 532). The side 532 is adjacent to the side 531 but not in contact with the second grounding part 521 and the fourth grounding part 522, and the side 532 is a side closest to the first grounding part 510 among multiple sides of the third grounding part 530 adjacent to the side 531.

The second grounding part 521 is a polyhedron and one of sections of the second grounding part 521 may be a C shape, but not limited thereto. Two ends of the second grounding part 521 may be respectively connected to the first grounding part 510 and the third grounding part 530 to form the second path 320 between the first feed point 110 and the second feed point 210.

The fourth grounding part 522 is a polyhedron and one of sections of the fourth grounding part 522 may be a C shape, but not limited thereto. Two ends of the fourth grounding part 522 may be respectively connected to the first grounding part 510 and the third grounding part 530 to form the first path 310 between the first feed point 110 and the second feed point 210.

Figure 5:
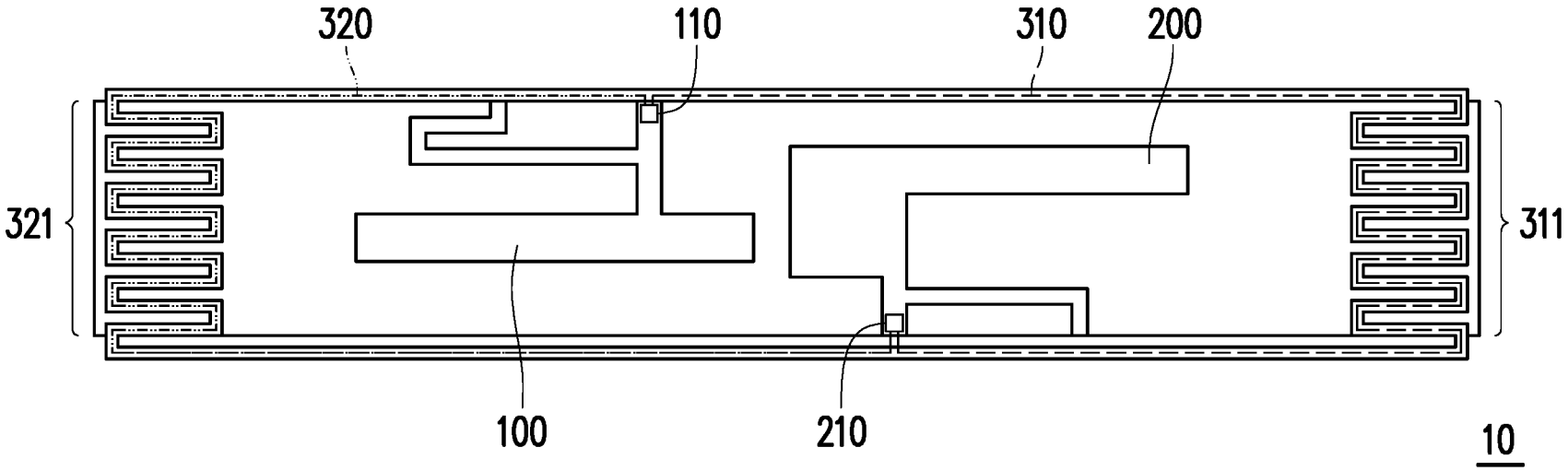
FIG. 5 is a schematic diagram illustrating another aspect of the dual-band antenna according an embodiment of the invention.

FIG. 5 is a schematic diagram illustrating another aspect of the dual-band antenna 10 according an embodiment of the invention. In this embodiment, the grounding component 300 include a meander structure 311 forming a part of the first path 310 and a meander structure 321 forming a part of the second path 320. When there is not enough space to extend the first path 310 such that the first path 310 is integer multiple of the wavelength of the first signal (or the second signal), antenna engineers can add the meander structure 311 in the grounding component 300. The meander structure 311 can extend the first path 310 with a small space. Similarly, when there is not enough space to extend the second path 320 such that the second path 320 is integer multiple of the wavelength of the first signal (or the second signal), antenna engineers can add the meander structure 321 in the grounding component 300. The meander structure 321 can extend the second path 320 with a small space.

In an embodiment, the meander structure 311 or the meander structure 321 may be realized by an inductor. In this way, antenna engineers can easily adjust the path length of the first path 310 or the second path 320 by changing a specification of the inductor included in the grounding component 300.

In summary, the dual-band antenna of the invention uses the grounding component to form the two paths between the two antennas, and the path length of each path is designed to be integer multiple of the wavelength of the input/output signal. As such, S21 parameter between the antennas will be significantly reduced. In order to form the two paths between the antennas, the grounding component may be, for example, the annulus structure. For allowing the path lengths between the antennas to be integral multiples of the wavelength of the signal in different scenarios, the grounding component can have many different aspects. The grounding component may include, for example, the meander structure or the inductor, so antenna engineers can adjust the path lengths simply by changing the length of the meander structure or the specification of the inductor.

What is claimed is:

1. A dual-band antenna, comprising:

a first antenna, having a first feed point for transceiving a first signal;

a second antenna, having a second feed point; and a grounding component, electrically coupled to the first feed point and the second feed point, wherein the grounding component forms a first path and a second path between the first feed point and the second feed point, wherein a first path length of the first path and a second path length of the second path are integer multiples of a first wavelength of the first signal.

2. The dual-band antenna according to claim 1, wherein the second feed point is configured to transceive a second signal, and the first path length and the second path length are integer multiples of a second wavelength of the second signal.

3. The dual-band antenna according to claim 1, wherein the grounding component is an annulus structure.

4. The dual-band antenna according to claim 1, wherein the grounding component comprises a meander structure, wherein the meander structure forms a part of the first path and a part of the second path.

5. The dual-band antenna according to claim 1, wherein the grounding component comprises an inductor, wherein the inductor forms a part of the first path and a part of the second path.

6. The dual-band antenna according to claim 1, wherein the grounding component comprises a hinge of a notebook computer.

7. The dual-band antenna according to claim 6, wherein the first antenna is disposed in a second body of the notebook computer, and the second antenna is disposed in a first body of the notebook computer.

8. The dual-band antenna according to claim 1, wherein the grounding component comprises a first grounding part, a second grounding part and a third grounding part, wherein the second grounding part is a polyhedron and one of sections of the second grounding part is a C shape, wherein the second grounding part connects the first grounding part to the third grounding part.

9. The dual-band antenna according to claim 8, wherein the first grounding part is a second polyhedron and one of sections of the first grounding part is an inverted-L shape, wherein the first feed point of the first antenna is disposed on a first side on the second polyhedron, wherein the first side is located at a lower edge of the inverted-L shape.

10. The dual-band antenna according to claim 8, wherein the third grounding part is a cuboid, and the second feed point of the second antenna is disposed on a first side of the cuboid, wherein the first side is partially in contact with the second grounding part.

* * * * *